US011378360B1

(12) United States Patent
Monat et al.

(10) Patent No.: US 11,378,360 B1
(45) Date of Patent: Jul. 5, 2022

(54) APPARATUSES AND WEARABLE ARMOR SYSTEMS INCLUDING ELECTRICAL SOURCES

(71) Applicant: Cornerstone Research Group, Inc., Miamisburg, OH (US)

(72) Inventors: Jacob A. Monat, Mendota Heights, MN (US); Joshua E. Nieman, Centerville, OH (US); Matthew S. Benefiel, Xenia, OH (US); Frank M. Zalar, Beavercreek Township, OH (US); Brian E. Henslee, Galloway, OH (US)

(73) Assignee: Cornerstone Research Group, Inc., Miamisburg, OH (US)

( * ) Notice: Subject to any disclaimer, the term of this patent is extended or adjusted under 35 U.S.C. 154(b) by 110 days.

(21) Appl. No.: 16/433,591

(22) Filed: Jun. 6, 2019

Related U.S. Application Data

(60) Provisional application No. 62/681,918, filed on Jun. 7, 2018.

(51) Int. Cl.
*F41H 5/04* (2006.01)
*F41H 5/013* (2006.01)
(Continued)

(52) U.S. Cl.
CPC ..... *F41H 5/0478* (2013.01); *A41D 1/002* (2013.01); *A41D 1/04* (2013.01); *F41H 5/013* (2013.01);
(Continued)

(58) Field of Classification Search
CPC ..... A41D 1/002; A41D 1/005; A41D 1/04; A41D 13/00; A41D 13/0015;
(Continued)

(56) References Cited

U.S. PATENT DOCUMENTS 3,550,159 A * 12/1970 Alarco ..... A41D 13/0155 2/463
5,008,517 A * 4/1991 Brekkestran ..... H05B 3/342 219/211
(Continued)

FOREIGN PATENT DOCUMENTS

WO 2014186042 A2 11/2014

OTHER PUBLICATIONS

Gould, "Firm Combines Battery and Armor Plate for Troops", https://www.defensenews.com/digital-show-dailies/modern-day-marine/2015/09/24/firm-combines-battery-and-armor-plate-for-troops/, 2015, 4 pgs.
(Continued)

*Primary Examiner* — Khaled Annis
*Assistant Examiner* — Dakota Marin
(74) *Attorney, Agent, or Firm* — Dinsmore & Shohl LLP

(57) ABSTRACT

An apparatus for an armor system includes a housing case, an interior ballistic panel, a frame, a power source, and a control unit. The housing case includes a top shell and a bottom shell, where the top shell is removably secured to the bottom shell, forming a cavity. The interior ballistic panel is removably arranged within the cavity between the top shell and the bottom shell. The frame is arranged within the cavity between the top shell and the interior ballistic panel, the frame including a compartment. The power source is arranged within the compartment of the frame, and the control unit is communicatively connected to the power source to manage operation of the power source.

17 Claims, 9 Drawing Sheets

(51) Int. Cl.

| | |
|---|---|
| ***A41D 1/00*** | (2018.01) |
| ***A41D 1/04*** | (2006.01) |
| *A41D 13/00* | (2006.01) |
| *A41D 13/012* | (2006.01) |
| *A41D 13/05* | (2006.01) |
| *A41D 31/18* | (2019.01) |

(52) U.S. Cl.
CPC ..... *A41D 1/005* (2013.01); *A41D 13/00* (2013.01); *A41D 13/0015* (2013.01); *A41D 13/012* (2013.01); *A41D 13/0525* (2013.01); *A41D 31/18* (2019.02); *A41D 31/185* (2019.02); *F41H 5/0414* (2013.01)

(58) Field of Classification Search
CPC .. A41D 13/012; A41D 13/0525; A41D 31/18; A41D 31/185; F41H 5/0478; F41H 5/013; F41H 5/0414
USPC ..... 2/464, 2.5
See application file for complete search history.

(56) References Cited

U.S. PATENT DOCUMENTS 5,221,807 A * 6/1993 Vives ..... F41H 5/0414 109/82
5,317,950 A * 6/1994 Binon ..... F41H 5/0478 2/2.5
5,349,893 A * 9/1994 Dunn ..... F41H 5/04 2/2.5
5,534,343 A * 7/1996 Landi ..... D03D 11/00 2/2.5
6,253,655 B1 * 7/2001 Lyons ..... F41H 5/0428 89/36.02
7,367,898 B2 * 5/2008 Hawkins ..... A41D 13/015 473/332
7,479,344 B1 1/2009 McDermott
8,240,610 B1 * 8/2012 Cooper ..... A41D 13/0155 2/2.14
8,308,489 B2 * 11/2012 Lee ..... H01R 13/2407 439/37
8,375,839 B2 * 2/2013 Landi ..... F41H 5/0478 89/36.02
8,853,891 B2 10/2014 Soar
9,200,871 B2 * 12/2015 Hexels ..... A45F 3/06
2005/0217471 A1 * 10/2005 Benitsch ..... F41H 5/0414 89/36.02
2008/0148929 A1 * 6/2008 Graphenius ..... F41H 5/0457 89/36.02
2009/0031467 A1 * 2/2009 Swindells ..... A45F 3/14 2/243.1
2010/0115680 A1 * 5/2010 Thomas ..... F41H 1/02 2/2.5
2012/0174764 A1 * 7/2012 Medwell ..... F41H 5/0478 89/36.05
2012/0182834 A1 7/2012 Mullen et al.
2012/0291188 A1 * 11/2012 Grosstesner ..... A41D 31/12 2/465
2013/0025021 A1 * 1/2013 Wright ..... A41D 1/002 2/102
2014/0130225 A1 * 5/2014 Balzano ..... F41H 1/02 2/2.5
2015/0303586 A1 * 10/2015 Hafenrichter ..... H01Q 1/40 343/893
2015/0335140 A1 * 11/2015 Cole ..... A44B 18/0073 24/3.1
2018/0128577 A1 * 5/2018 Beck ..... F41H 5/0478
2018/0249133 A1 8/2018 Thiel et al.

OTHER PUBLICATIONS

Koon, "Soldiers Reap Rewards of Wearable Battery Design Rethink", http://intelligentsystemssource.com/soldiers-reap-rewards-of-wearable-battery-design-rethink/, 2017, 6 pgs.
Sbir, "High-performance body armor-integrated, multifunctional batteries for dismounted soldier", 2016, 3 pgs.

* cited by examiner

APPARATUSES AND WEARABLE ARMOR SYSTEMS INCLUDING ELECTRICAL SOURCES

CROSS-REFERENCE TO RELATED APPLICATIONS

This application claims the benefit of U.S. Provisional Application Ser. No. 62/681,918, filed Jun. 7, 2018.

STATEMENT REGARDING FEDERALLY SPONSORED RESEARCH OR DEVELOPMENT

This invention was made with Government support under Contract Number FA8650-16-M-2681 and FA8650-17-C-2734 awarded by the U.S. Air Force Materiel Command to Cornerstone Research Group Inc. The Government has certain rights in the invention.

TECHNICAL FIELD

The present disclosure generally relates to apparatuses and wearable armor systems including electrical sources, and more specifically, to a conformal battery-integrated armor system.

BACKGROUND

A significant number of military assets, including multiple types of soldier-worn systems, rely heavily on power provided by rechargeable batteries. As the capabilities of these systems increase, there is an ever-increasing need for batteries with more electrical energy/power. Along with the increasing need for additional electrical capacity to support these growing energy demands comes added weight and mounting space limits due to additional batteries being added to a soldier's already heavy carrying load. Additionally, batteries can be bulky, cumbersome, and restrict body movement for the dismounted soldier.

Conformal batteries (e.g. Conformal Wearable Battery, CWB) seeking to address the space limitations and operator ergonomics have been developed due to the increased need in electrical capacity. However, current conformal batteries offer reduced ballistics protection when combined with soft armor Kevlar® (E.I. du Pont de Nemours and Company, Midland, Mich.) packaging that has limited stopping protection. An alternative approach is to use Small Arms Protective Insert (SAPI) plates with the conformal batteries because of the greater ballistics protection, but such levels of ballistic protection may not be required in every situation, with the SAPI plates only adding to the carrying weight concern.

Accordingly, there is a need for improved apparatuses and wearable armor systems including electrical sources.

SUMMARY

According to a first aspect, an armor system includes a housing case, a frame, a power source, and a control unit. The housing case includes a top shell and a bottom shell, where the top shell is removably secured to the bottom shell, forming a cavity. The frame is arranged within the cavity between the top shell and the bottom shell, the frame including a compartment. The power source is arranged within the compartment of the frame, and the control unit is communicatively connected to the power source to manage operation of the power source.

According to any of the previous aspects, an interior ballistic panel is removably arranged within the cavity between the top shell and the bottom shell.

According to any of the previous aspects, the frame is removably positioned into the cavity between the top shell and the bottom shell and further includes a plurality of compartments.

According to any of the previous aspects, the plurality of compartments is formed by a plurality of ribs forming the frame.

According to any of the previous aspects, the plurality of ribs are perpendicularly arranged.

According to any of the previous aspects, the control unit is arranged within at least one compartment of the frame.

According to any of the previous aspects, the power source is a plurality of batteries.

According to any of the previous aspects, the plurality of batteries are arranged within corresponding compartments of the plurality of compartments of the frame.

According to any of the previous aspects, the armor system further includes an external connector passing through the housing case and communicatively connected to the plurality of batteries and the control unit.

According to any of the previous aspects, the external connector includes a socket communicatively coupled to the plurality of batteries, and a flexible power cable removably secured to the socket. The flexible power cable allows current to be transmitted from the plurality of batteries to an external device.

According to any of the previous aspects, the housing case is formed from a fiber-reinforced composite material comprising reinforcement material and polymer.

According to any of the previous aspects, the reinforcement material includes one or more components selected from the group consisting of carbon fiber, glass fiber, aramid fiber, polypropylene fiber, polyethylene fiber, hybrid laminates, thermoplastic prepreg, or combinations thereof, and wherein the polymer includes one of more components selected from the group consisting of polypropylene, polyethylene, polyether ether ketone, polyphenylene oxide, polyphenylene ether, polyvinylidenefluoride, epoxy, vinyl ester, polyester, polyurethane, thermoplastic elastomer, thermoset elastomer, or combinations thereof.

According to any of the previous aspects, a curved profile of the interior ballistic panel matches a curved profile of the housing case.

According to a second aspect, an armor system includes a housing case, an interior ballistic panel, a plurality of longitudinally arranged ribs, a plurality of latitudinally arranged ribs, a power source, and a control unit. The housing case includes a top shell and a bottom shell. The top shell is removably secured to the bottom shell, forming a cavity. The interior ballistic panel is removably arranged within the cavity between the top shell and the bottom shell. The plurality of longitudinally arranged ribs is arranged within the cavity. The plurality of latitudinally arranged ribs is arranged over the plurality of longitudinally arranged ribs. The plurality of longitudinally arranged ribs are secured to the plurality of latitudinally arranged ribs, forming a plurality of compartments. The power source is arranged within at least one of the plurality of compartments, and the control unit is arranged within at least one of the plurality of compartments and is communicatively connected to the power source to manage operation of the power source.

According to any of the previous aspects, the plurality of longitudinally arranged ribs and the plurality of latitudinally arranged ribs are integral with one another to form a frame.

According to any of the previous aspects, the power source is a plurality of batteries.

According to any of the previous aspects, the armor system further includes an external connector passing through the housing case and communicatively connected to the plurality of batteries and the control unit.

According to any of the previous aspects, the external connector includes a socket communicatively coupled to the plurality of batteries, and a flexible power cable removably secured to the socket. The flexible power cable allows current to be transmitted from the plurality of batteries to an external device.

According to any of the previous aspects, the housing case is formed from a fiber-reinforced composite material having ballistic resistance.

According to any of the previous aspects, the housing case is formed from a fiber-reinforced composite material comprising reinforcement material and polymer.

According to any of the previous aspects, the reinforcement material includes one or more components selected from the group consisting of carbon fiber, glass fiber, aramid fiber, polypropylene fiber, polyethylene fiber, hybrid laminates, thermoplastic prepreg, or combinations thereof, and wherein the polymer includes one of more components selected from the group consisting of polypropylene, polyethylene, polyether ether ketone, polyphenylene oxide, polyphenylene ether, polyvinylidenefluoride, epoxy, vinyl ester, polyester, polyurethane, thermoplastic elastomer, thermoset elastomer, or combinations thereof.

According to a third aspect, an armor system includes a carrier vest, a ballistic panel holding pouch, a housing case, an interior ballistic panel, a frame, a power source, a control unit, and an exterior ballistic panel. The ballistic panel holding pouch is operatively arranged on the carrier vest. The housing case includes a top shell and a bottom shell. The top shell is removably secured to the bottom shell, forming a cavity. The interior ballistic panel is removably arranged within the cavity between the top shell and the bottom shell. The frame is arranged within the cavity between the top shell and the interior ballistic panel, the frame including a compartment. The power source is arranged within the compartment of the frame, and the control unit is communicatively connected to the power source to manage operation of the power source. The exterior ballistic panel is secured to an external face of the housing case. The housing case and the exterior ballistic panel are arranged within the ballistic panel holding pouch.

According to any of the previous aspects, the armor system further includes an external connector passing through the housing case and communicatively connected to the power source and the control unit.

According to any of the previous aspects, the frame further includes a plurality of longitudinally arranged ribs and a plurality of latitudinally arranged ribs forming a plurality of compartments within the frame.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The armor system generally includes a housing case, an interior ballistic panel, a frame, a power source, and a control unit. The housing case includes a top shell and a bottom shell, where the top shell is removably secured to the bottom shell, forming a cavity. The interior ballistic panel is removably arranged within the cavity between the top shell and the bottom shell. The frame is arranged within the cavity between the top shell and the interior ballistic panel, the frame including a compartment. The power source is arranged within the compartment of the frame, and the control unit is communicatively connected to the power source to manage operation of the power source. As will be described in greater detail herein, the interior ballistic panel, frame, and power source may be easily removed from the cavity of the housing case. For example the interior ballistic panel could be removed if additional ballistics protection is not required beyond the level of ballistic protection of the housing case. Accordingly, the interior ballistic panel can replaced with a different ballistic protection panel, such as a small arms protective insert (SAPI) panel, a soft Kevlar® (E.I. du Pont de Nemours and Company, Midland, Mich.) insert, a ceramic armor panel, an ultra-high-molecular-weight polyethylene (UHMWPE) panel, a dry fiber material panel, or a composite material panel. The ceramic armor panel may be made from alumina, boron carbide, silicon carbide, or titanium diboride. The UHMWPE panel may be made from Dyneema® (DSM, Heerlen, the Netherlands) and/or Spectra® (Honeywell, Morris Plains, N.J.). The dry fiber material panel may be made of Kevlar® (E.I. du Pont de Nemours and Company, Midland, Mich.) or carbon fiber. The composite material panel may be made with Kevlar® (E.I. du Pont de Nemours and Company, Midland, Mich.) or carbon fiber. Various embodiments of the armor system will be described in greater detail herein.

Figure 1:
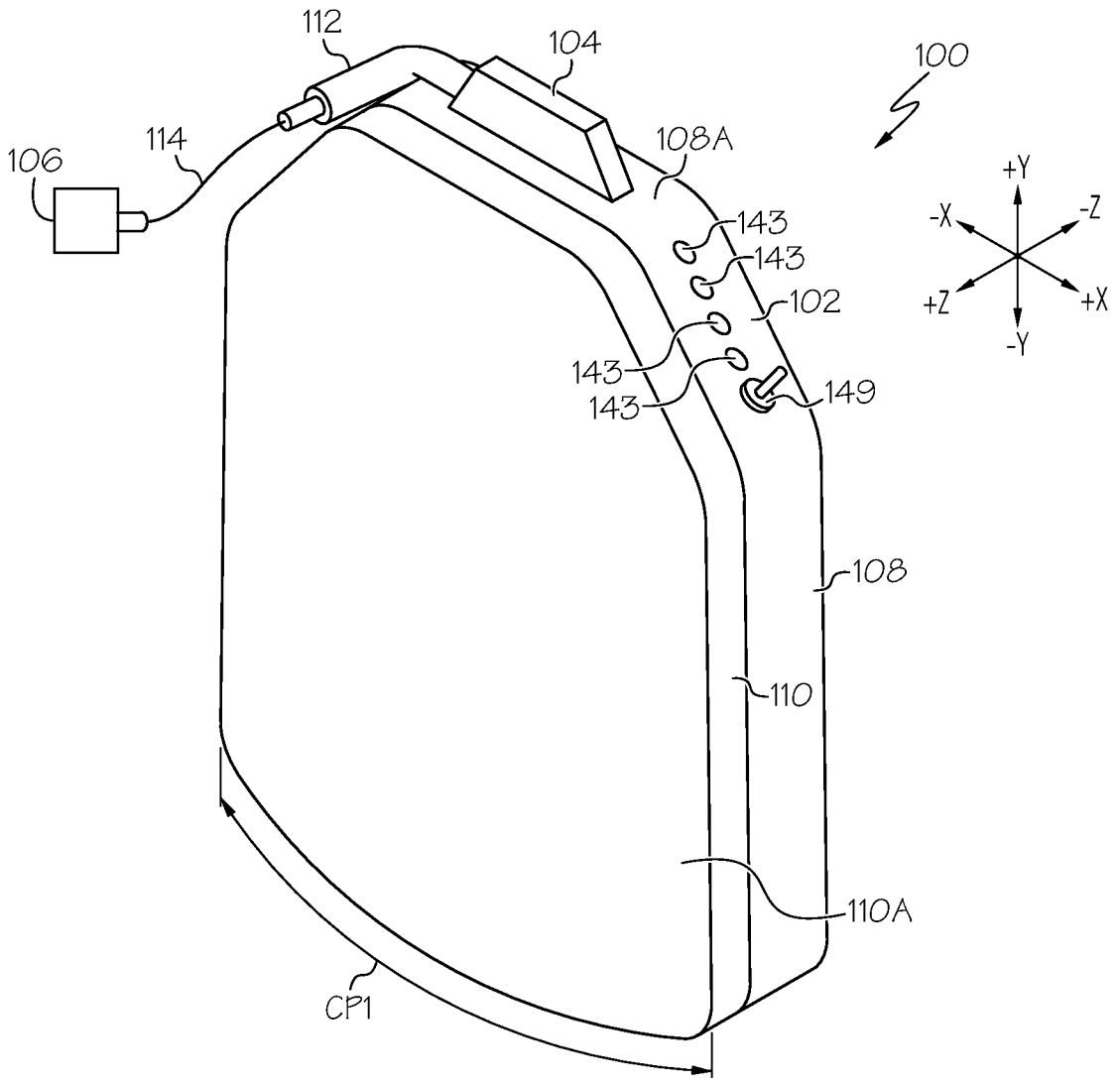
FIG. 1 schematically depicts an armor system, according to one or more embodiments shown or described herein.

Referring now to FIG. 1, an embodiment of an armor system 100 is generally depicted. As illustrated, the armor system 100 may include a housing case 102, an external connector 104, and an external device 106. As will be described in greater detail herein, the armor system 100 is configured to be modular to allow for the repair of damaged components and replacement of components for situation specific instances. It is noted that the present armor system could also be used in any applications where there is a need for electrical power or ballistic protection.

Referring again to FIG. 1, the housing case 102 may have an exterior geometry that matches commonly used SAPI plate and include a bottom shell 108 and a top shell 110. The bottom shell 108 may further include a top surface 108A to allow the external connector 104 to sit flush against the housing case 102. The bottom shell 108 may also include holes 107 (FIG. 2) which allow LEDs 143 to pass through the bottom shell 108. A button 149 may also be arranged within a through-bore of bottom shell 108 to allow a user to activate LEDs 143. LEDs 143 may be arranged to communicate to a user the charge level of the power sources contained within the armor system 100, or to inform the user of a damaged components or a charging state. It will be appreciated that the holes 107, LEDs 143, and button 149 may also be positioned with the top shell. Additionally, the top shell 110 may further include an external face 110A to allow an exterior ballistic panel to be abutted against the top shell 110 (see FIG. 8).

In various embodiments, the bottom shell 108 and top shell 110 may be secured together by a friction fit, a removable adhesive, or an external fabric or tape wrap, but any securement means can be used without departing from the scope of this disclosure.

It is noted that the housing case 102 and/or various components thereof may be made from a variety of materials. For example, in one non-limiting embodiment, the housing case 102 is made from a fiber-reinforced composite, such as an aramid fiber (Kevlar® (E.I. du Pont de Nemours and Company, Midland, Mich.)) reinforced composite. In a further non-limiting embodiments, the housing case 102 is made from a rigid plastic such as acrylonitrile butadiene styrene (ABS) or nylon, polycarbonate, UHMWPE. It should be noted that both the bottom shell 108 and the top shell 110 have a curved profile CP1, which allows the housing case 102 to conform to the chest area of a human user. However, it should be appreciated that housing case 102 can also have a flat profile. In some embodiments, the housing case 102 is a rigid or conformal case which may be environmentally sealed against dust and water intrusion (e.g. IP67 or IP68 in accordance with the International Electrotechnical Commission standards). Additionally, the housing case 102 may be rated for MIL-STD-810 shock, vibration, and drop testing in accordance with the Institute of Environmental Sciences and Technology standards of the United States Military. The armor system 100 may be designed to provide additional ballistic protection when worn in front of or behind the interior ballistic panel 116, or may act as standalone ballistic protection (e.g. NIJ Level IIA, II, III, or IV in accordance with the National Institute of Justice standards) when worn without the interior ballistic panel 116.

In some embodiments, the housing case 102 may be made from a thin, impact/ballistic resistant case material which may be a thermoplastic or thermoset resin case, with or without fiber reinforcement. A lightweight, thermally insulated, fire-resistant layer may be arranged between the interior ballistic panel 116 and the bottom shell 108 to protect a user in the event of battery thermal runaway or a fire. Example fire-resistant layers include those formed from dry fibers of Kevlar® (E.I. du Pont de Nemours and Company, Midland, Mich.), and/or carbon fibers, ceramic materials or foam.

In some embodiments, the polymer materials used to make the housing case 102 can be a fiber reinforced thermoplastic or thermoset composite. Non-limiting examples of thermoplastic resin used to make the bottom shell 108 and the top shell 110 are polypropylene, polyethylene, polyether ether ketone, polyphenylene oxide, polyphenylene ether, Noryl, and polyvinylidenefluoride. Non-limiting examples of thermosetting resin used to make the bottom shell 108 and the top shell 110 are epoxy, vinyl ester, polyester, polyurethane. Non-limiting examples of fiber reinforcement materials in the composite include carbon, glass, aramid, polypropylene, polyethylene, and hybrid laminates made with multiple reinforcement materials. The fiber reinforcement used to make the composite may include various material forms, including but not limited to random mats, scrims, chopped fibers, knits, unidirectional plies, three-dimensional weaves, three-dimensional fiber preforms, plain weave fabrics, twill fabrics, harness satin fabrics, prepreg (i.e. pre-impregnated composite fibers where a thermoset polymer matrix material, such as epoxy, or a thermoplastic resin is already present), Tpreg (i.e. thermoplastic prepreg), or combinations thereof. In some embodiments, the polymer materials used to make the housing case 102 can be a fiber reinforced thermoplastic or thermoset elastomer composite. Non-limiting example of thermoplastic or thermosetting resin used to make elastomer composite for the housing case 102 are rubber, polyurea, or polyurethane.

Referring still to FIG. 1, the external connector 104 may include a socket 112 and a flexible power cable 114. The external connector 104 may be removably arranged to the top surface 108A. The external connector 104 connects with the internal comments within the housing case 102 through aperture 125 arranged in the top surface 108A (see FIG. 2). The power cable 114 can connect the armor system 100 with an external device 106 in order to power the external device 106. Examples of external device 106 include a radio, light source, mobile device, or the like. The power cable 114 can be removably secured to the external device 106 and the socket 112. In some embodiments, the power cable 114 is a silicone insulated high strand count wire.

Figure 2:
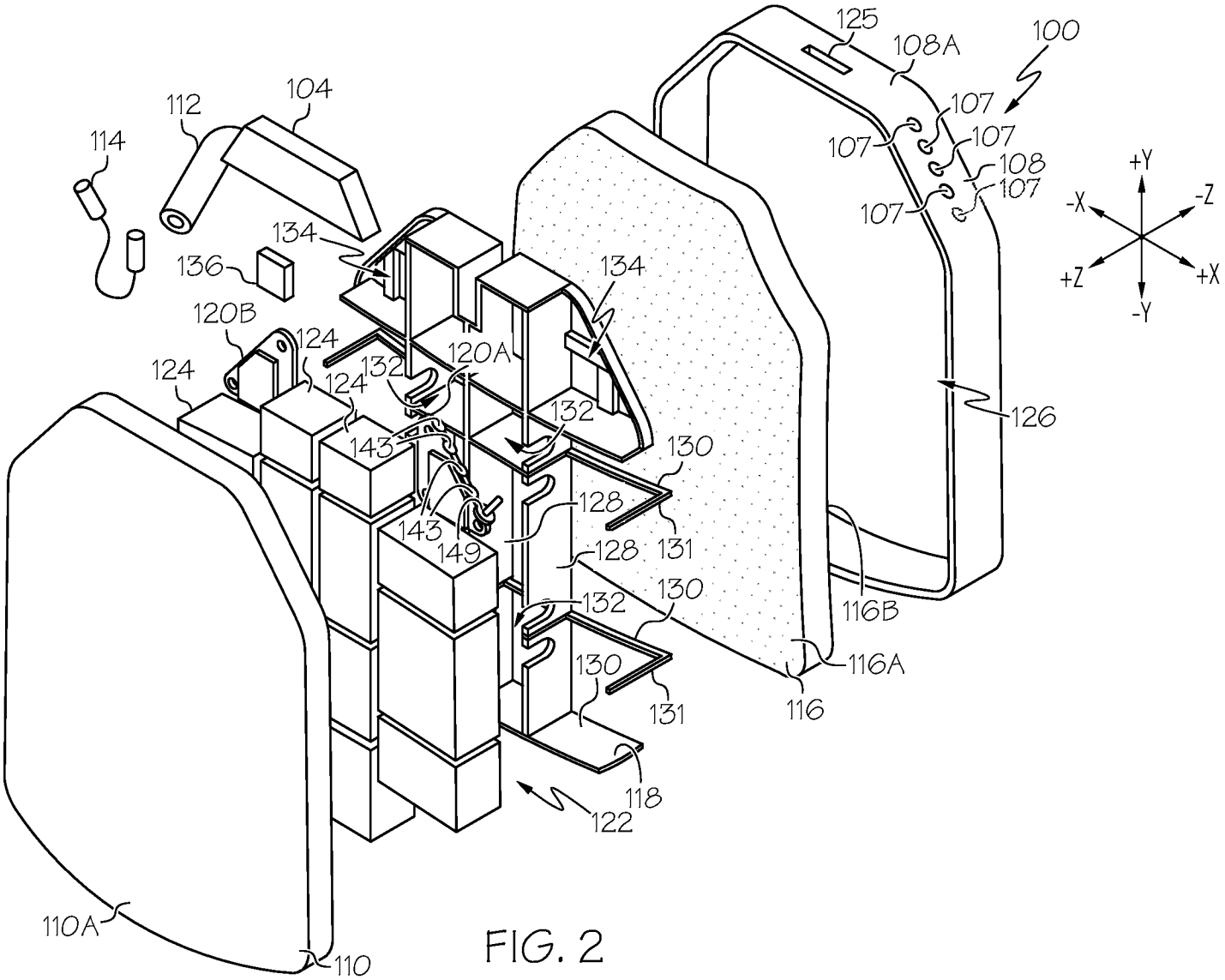
FIG. 2 schematically depicts an exploded view of the armor system of FIG. 1, according to one or more embodiments shown or described herein.

Referring now to FIG. 2, the armor system 100 may further include an interior ballistic panel 116, a frame 118, and a power source 122, all arranged within the cavity 126 formed between the bottom shell 108 and the top shell 110. As depicted in FIG. 2, the bottom shell 108 further includes an aperture 125, which allows for an external connector 136 to pass through the housing case 102 to connect the power source 122 with an external device 106 (FIG. 1).

Still referring to FIG. 2, the interior ballistic panel 116 is arranged behind the frame 118 and power source 122 in the +/−Z direction. In some embodiments, the interior ballistic panel 116 may be arranged in front of the frame 118 and power source 122 in the +/−Z, or an interior ballistic panel 116 may be omitted from the housing case 102 since a specific situation may not require the additional ballistic protection besides that provided from the housing case 102. The frame 118 abuts against the surface 116A of the interior ballistic panel, while the bottom shell 108 abuts against the surface 116B of the interior ballistic panel.

Still referring to FIG. 2, the frame 118 may be arranged within the cavity 126 to abut against the interior ballistic panel 116 along surface 116A, or the housing case 102 when the armor system 100 is assembled. The frame 118 includes a plurality of latitudinally arranged ribs 128 in the +/−Y direction, and a plurality of longitudinally arranged ribs 130 in the +/−X direction. The plurality of latitudinally arranged ribs 128 may be arranged perpendicular to and secured to the plurality of longitudinally arranged ribs 130 to form a plurality of compartments 132 in the frame 118. In some embodiments, such compartments may be rectangular in shape to match the shape of the battery to be housed inside these compartments. In some embodiments, the frame 118 can be made from an integral piece of material, such as injection molded or 3D printed nylon material. The frame 118 may provide additional rigidity and reinforcement to the ballistic housing case to improve ballistic performance of the system. In some embodiments, the longitudinally arranged ribs 130 may include tabs 131 arranged on the end of the longitudinally arranged ribs 130. The tabs 131 may be used to form additional compartments 132 within the frame 118, or may be used to secure the frame 118 within the housing case 102 by abutting against the housing case 102 when the frame 118 is within the cavity 126.

Still referring to FIG. 2, the frame 118 may also include control unit compartments 134, which may be non-rectangular or triangular to match the shape of the housing case 102 and to allow maximum number of batteries to be placed into rectangular battery compartments. In some embodiments, a single control unit may be split into two or more separate control units 120A and 120B to fit within the sizing of the control unit compartments 134. Control units 120A and 120B are shaped to fit within the shape of the control unit compartments 134. Each of the separated control units 120A and 120B may control different functions of the armor system 100.

In some embodiments, the control units 120A and 120B are printed circuit boards having one or more of the following features: flat or conformal circuit boards, overcurrent protection, overvoltage protection, undervoltage protection, a state-of-charge (SOC) measurement, a SOC indication via external LEDs 143, a state-of-health (SOH) indication via external LEDs 143 (e.g. indicating remaining battery life or capacity), a system management bus (SMBus) for SOC and SOH data and charge control, passive and/or active battery cell balancing where active cell balancing can maintain similar SOC between all batteries 124 during charging and discharging, a capability of disabling individual batteries 124 or a string of batteries 124 in the event of malfunction or damage, and optionally provide multiple output voltages to reduce/eliminate the need for downstream DC-DC converters for different voltages.

Still referring to FIG. 2, power source 122 includes a plurality of batteries 124. In some embodiments, each battery 124 is a single, closed-system battery which may be removed separately from the remainder of the plurality if a single battery 124 is damaged or in need of replacement. The plurality of batteries 124 fit within the compartments 132 of the frame 118, with each battery 124 being arranged within a single compartment 132. In some embodiments, the batteries 124 may be the same size and shape.

In some embodiments, the batteries 124 may be high specific energy rechargeable battery cells. Specifically, the batteries 124 may be high specific energy rechargeable lithium battery cells. The batteries 124 may also have inherent fail-safe capabilities for the following conditions per United Nations Transportation Testing for Lithium Ion and Lithium Metal Batteries (UN Manual of Tests and Criteria § 38.3): Crush, Puncture, Short circuit, Over-discharge, Over-charge, Altitude, Shock, and Vibration. Additionally, in some embodiments, the power source 122 may have a discharge capacity of 5-30 Ah, preferably 8-12 Ah, a nominal voltage of 10-36V, 10-18V, or 20-36, an total energy of 50-400, preferably 100-300 Wh, a continuous discharge of 5-30 A, and a pulse discharge of 20-120 A.

Figure 3:
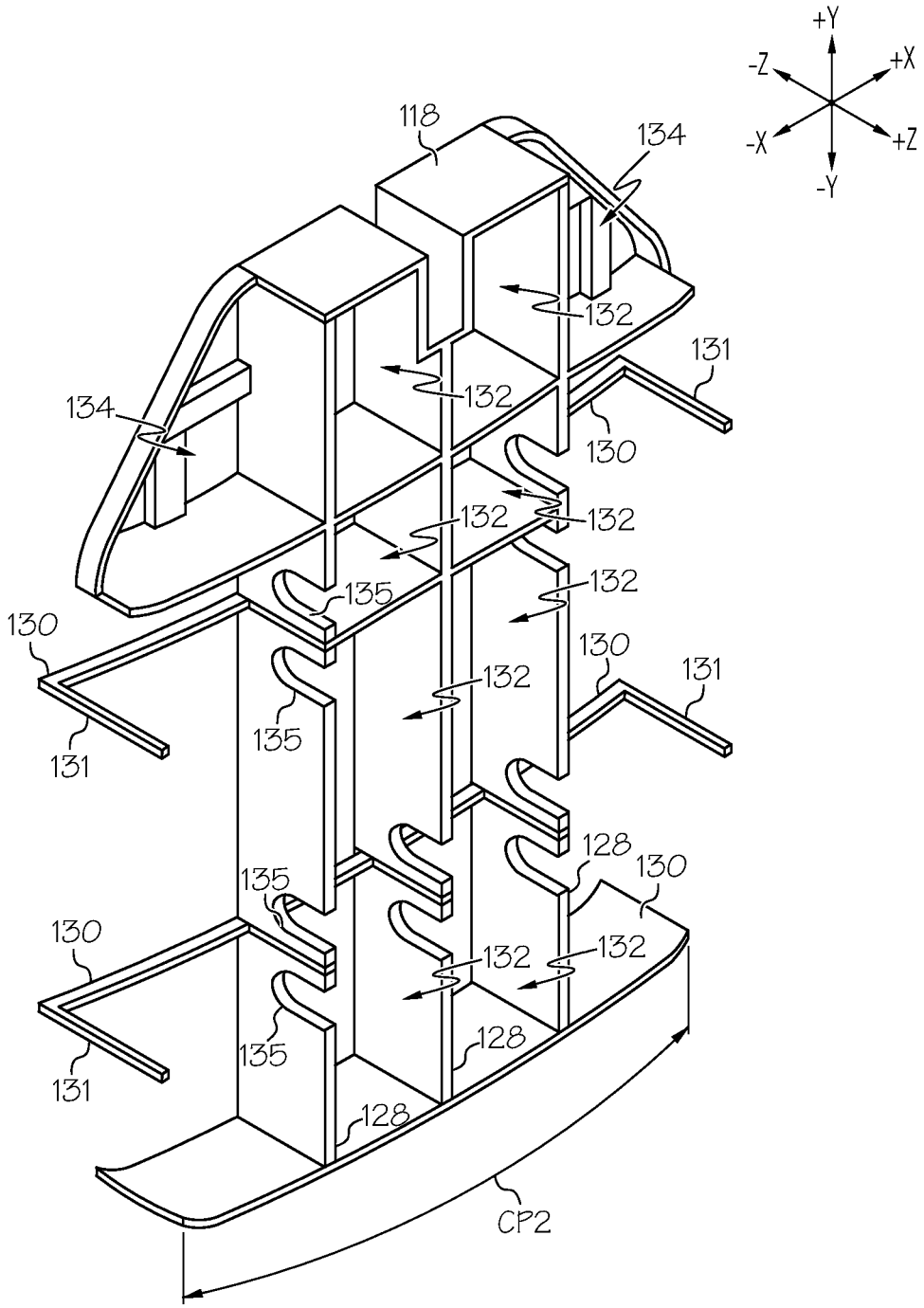
FIG. 3 schematically depicts a frame of the armor system of FIG. 1, according to one or more embodiments shown or described herein.

Referring now to FIG. 3, the frame 118 may further include channels 135 arranged in the plurality of latitudinally arranged ribs 128. The channels 135 are arranged to allow wiring harnesses form the control units 120A and 120B to pass between the compartments 132 when the armor system 100 is assembled. Additionally, the frame 118 may have a curved profile CP2, which allows the frame 118 to be arranged flush within the housing case 102, since the housing case 102 also has a curved profile CP1, as stated above. In some embodiments, the curved profile CP1 is identical to the curved profile CP2.

Figure 4:
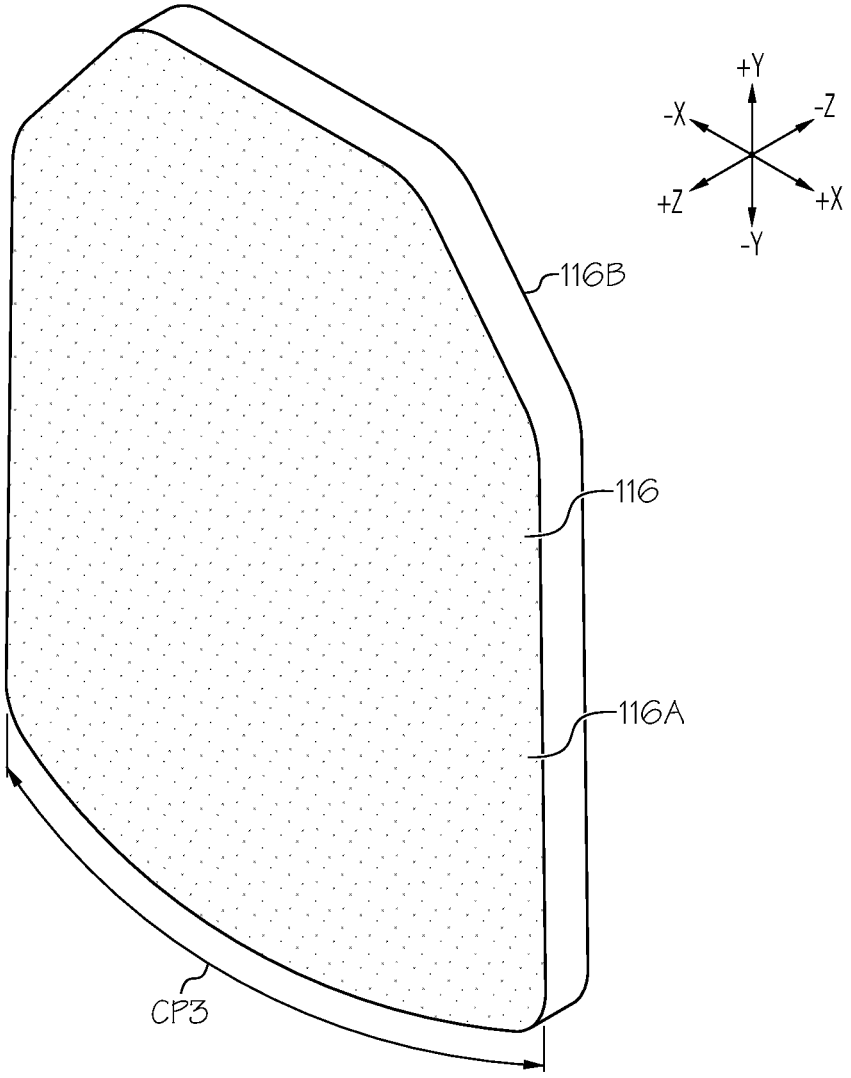
FIG. 4 schematically depicts an interior ballistic panel of the armor system of FIG. 1, according to one or more embodiments shown or described herein.
Figure 5A:
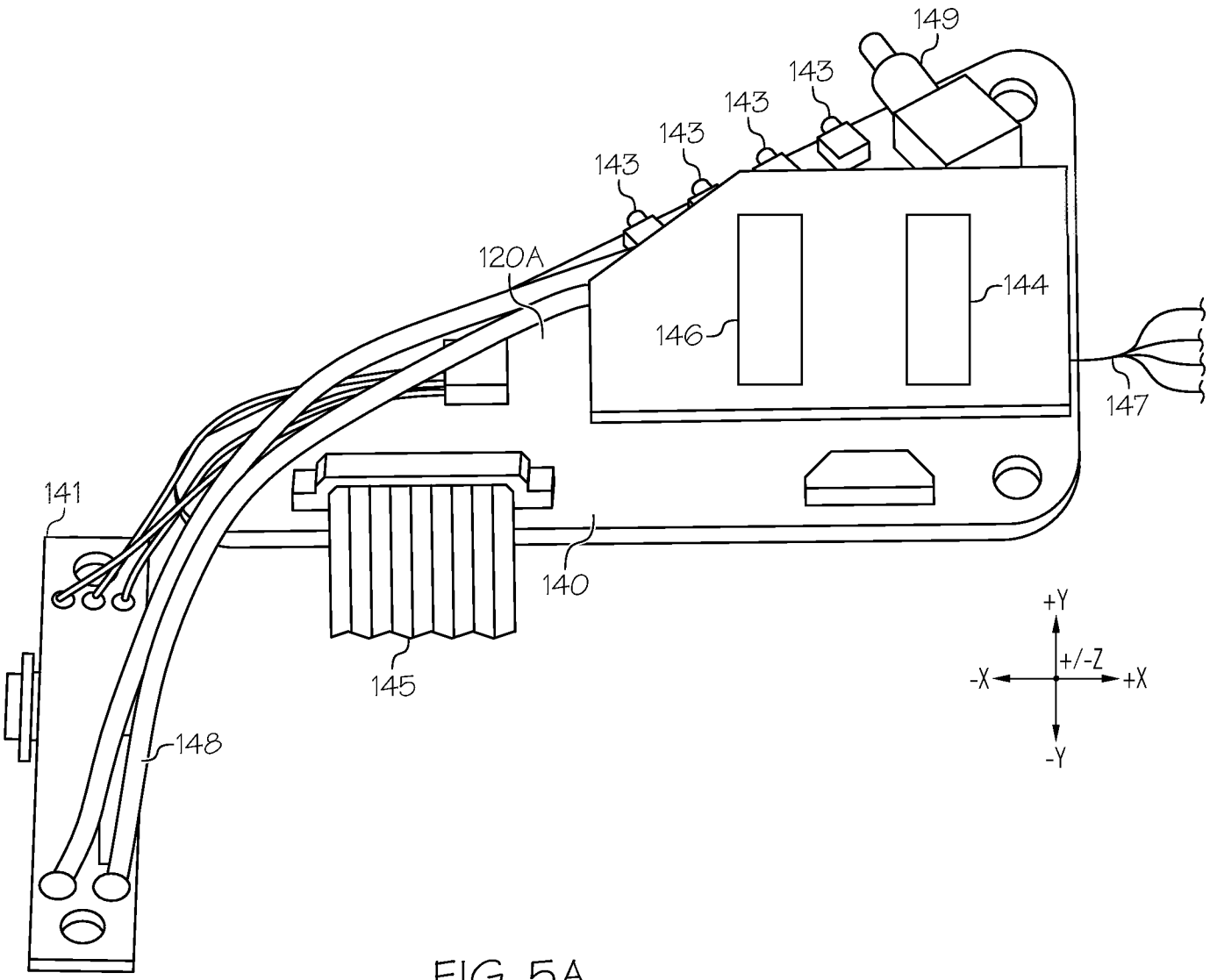
FIG. 5A schematically depicts a control unit of the armor system of FIG. 1, according to one or more embodiments shown or described herein.

Referring now to FIG. 4, the interior ballistic panel 116 may have a curved profile CP3, which allows the interior ballistic panel 116 to be arranged flush within the housing case 102, since the housing case also has a curved profile CP1, as stated above. In some embodiments, the curved profile CP1 is identical to the curved profile CP3. Additionally, the curved profile CP3 of the interior ballistic panel 116 allows the frame 118 to abut flush against the interior ballistic panel 116 when arranged within the housing case 102. In some embodiments, the curved profiles CP1, CP2, and CP3 are identical. The interior ballistic panel 116 may vary from a small arms protective insert (SAPI) to a soft Kevlar® (E.I. du Pont de Nemours and Company, Midland, Mich.) insert. Other examples include ceramic armor panel made with materials such as alumina, boron carbide, silicon carbide, titanium diboride, Ultra-high-molecular-weight polyethylene (UHMWPE) panel such as Dyneema® (DSM, Heerlen, the Netherlands) and Spectra® (Honeywell, Morris Plains, N.J.), Dry fiber material of Kevlar® (E.I. du Pont de Nemours and Company, Midland, Mich.) or carbon fiber, and composite material made with Kevlar® (E.I. du Pont de Nemours and Company, Midland, Mich.) or carbon fiber Referring now to FIG. 5A, the control unit 120A includes a circuit board 140, voltage controller 141, LEDs 143, a fuel gauge integrated circuit (IC) microcontroller 144, a connector cable 145, a temperature sensor 146, a wiring harness 147, and the button 149. The fuel gauge integrated circuit (IC) microcontroller 144, temperature sensor 146, and wiring harness 147 may be arranged on the circuit board 140. The voltage controller 141 is communicatively connected to the circuit board 140 via wire 148. As stated above, the LEDs 143 and button 149 allow a user to receive output information form the armor system 100, such as power supply level and charge status. The fuel (gas) gauge Integrated Circuit (IC) microcontroller 144 may monitor and provide output to control the charge and discharge functionality of the batteries. The connector cable 145 is arranged to connect the control unit 120A with the control unit 120B in order to pass communication signals between the two separate control units, which are working together as a single control unit. The temperature sensor 146 may determine the temperature of the batteries 124 during operation, and can alert a user to changes within the system based on the temperature change, such as if a battery 124 is damaged, thermal runaway may be happening within the housing case 102. The wiring harness 147 allows the circuit board 140 to communicatively connect with each battery 124 of the power source 122. In some embodiments, both power and communication signals may be sent via the wiring harness 147.

Figure 5B:
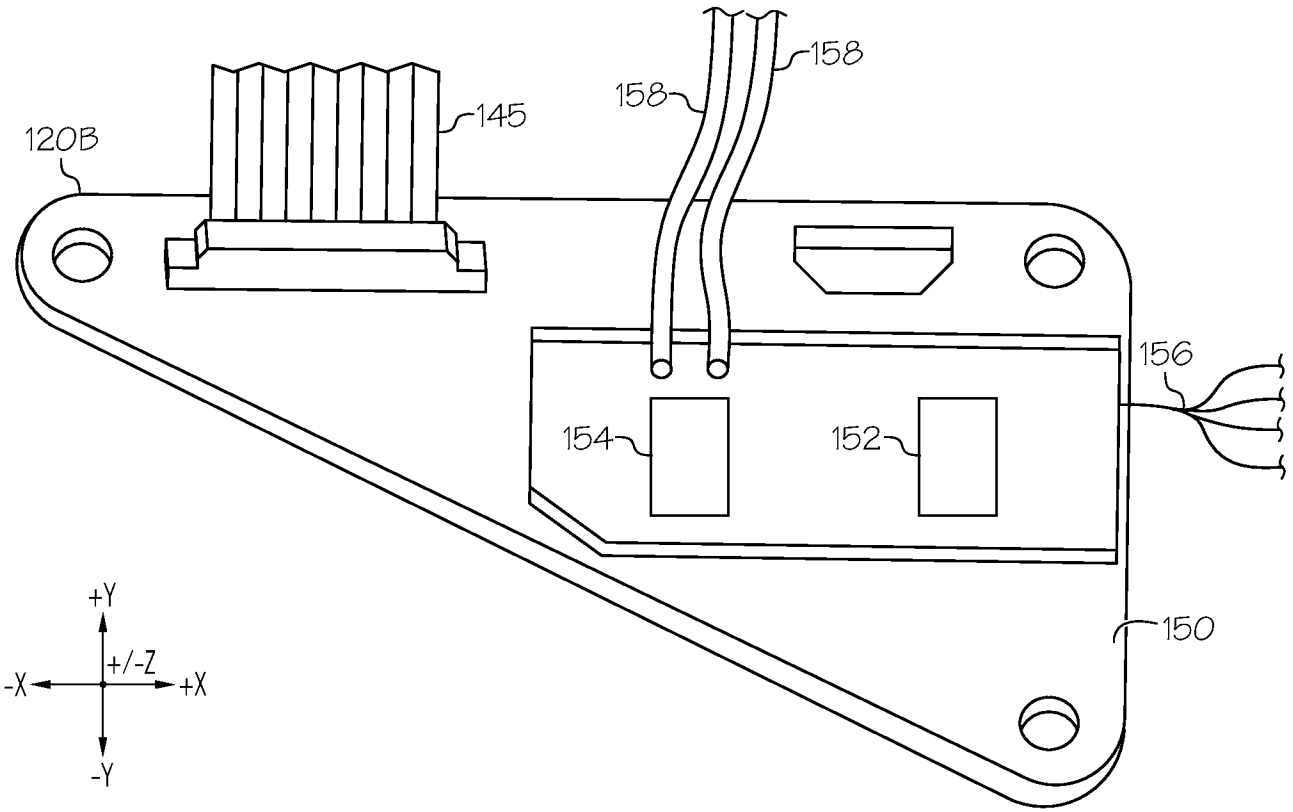
FIG. 5B schematically depicts a control unit of the armor system of FIG. 1, according to one or more embodiments shown or described herein.

Referring now to FIG. 5B, control unit 120B includes circuit board 150, a transistor 152, a resistor 154, a wiring harness 156, and external power cables 158. The transistor 152, resistor 154, wiring harness 156, and external power cables 158 are all communicatively connected to the circuit board 150. The connector cable 145 is also communicatively connected to the circuit board 150, and allows the control units 120A and 120B to send signals and power to one another. In some embodiments, the transistor 152 may be a bi-directional metal-oxide-semiconductor field-effect transistor (MOSFETs) that controls the current flow from the plurality of batteries 124. Additionally, the resistor 154 may be a shunt resistor that measures the current flow form the plurality of batteries 124. The transistor 152 and resistor 154 are communicatively connected with the batteries 124 via the wiring harness 156. The external power cables 158 allow power to be transferred from the batteries 124, through the control units 120A and 120B, and out to the external connector 136. However, the external power cables 158 may be fed through the aperture 125 in the housing case 102 to power and external device 106.

Figure 6:
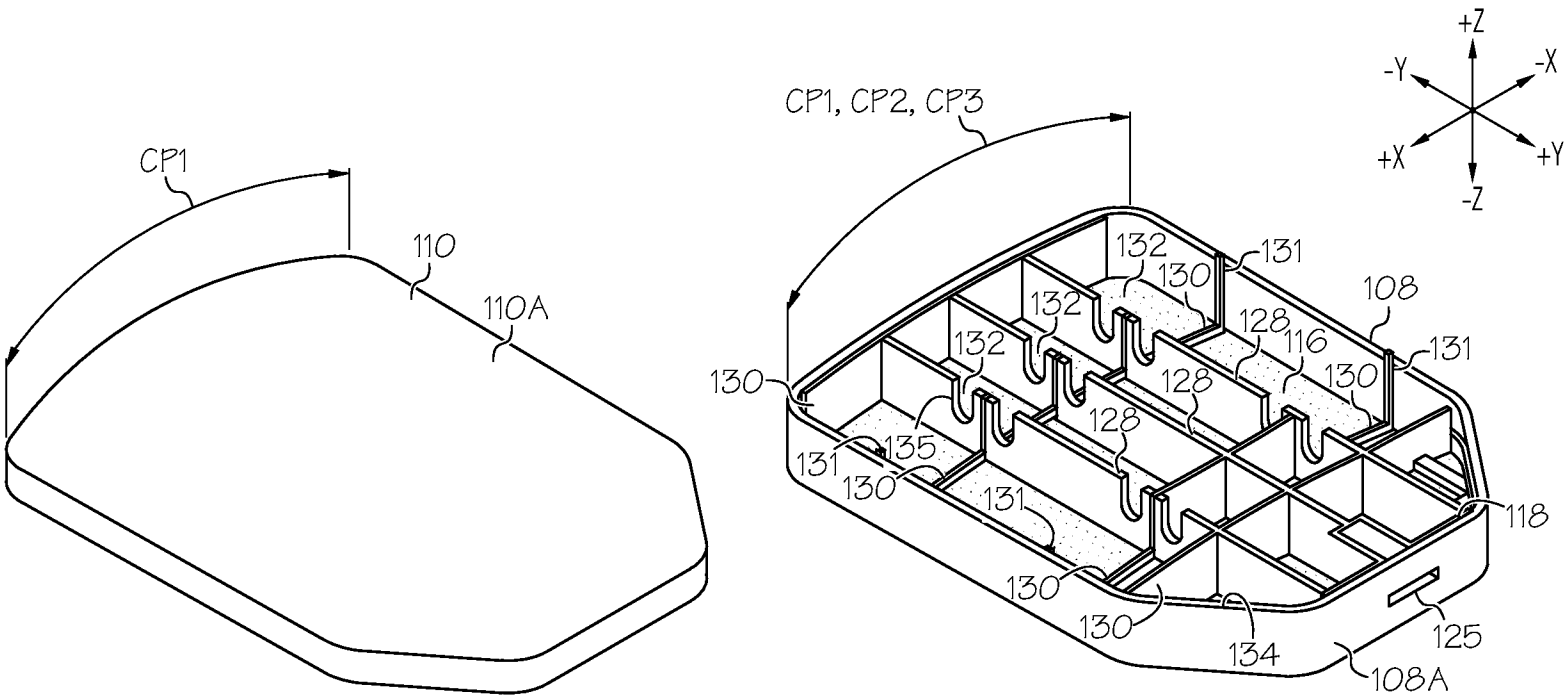
FIG. 6 schematically depicts the armor system of FIG. 1 with a plurality of electrical sources removed, according to one or more embodiments shown or described herein.

Referring now to FIG. 6, the frame 118 fits within the cavity 126 of the bottom shell 108, with the tabs 131 abutting the side of the bottom shell 108. As noted above, the curved profiles CP1, CP2, and CP3 of the housing case 102, interior ballistic panel 116, and frame 118, respectively, align within one another to allow the interior ballistic panel 116 and the frame 118 to nest within the housing case 102. In some embodiments, the interior ballistic panel 116 is not arranged within the housing case 102.

Figure 7:
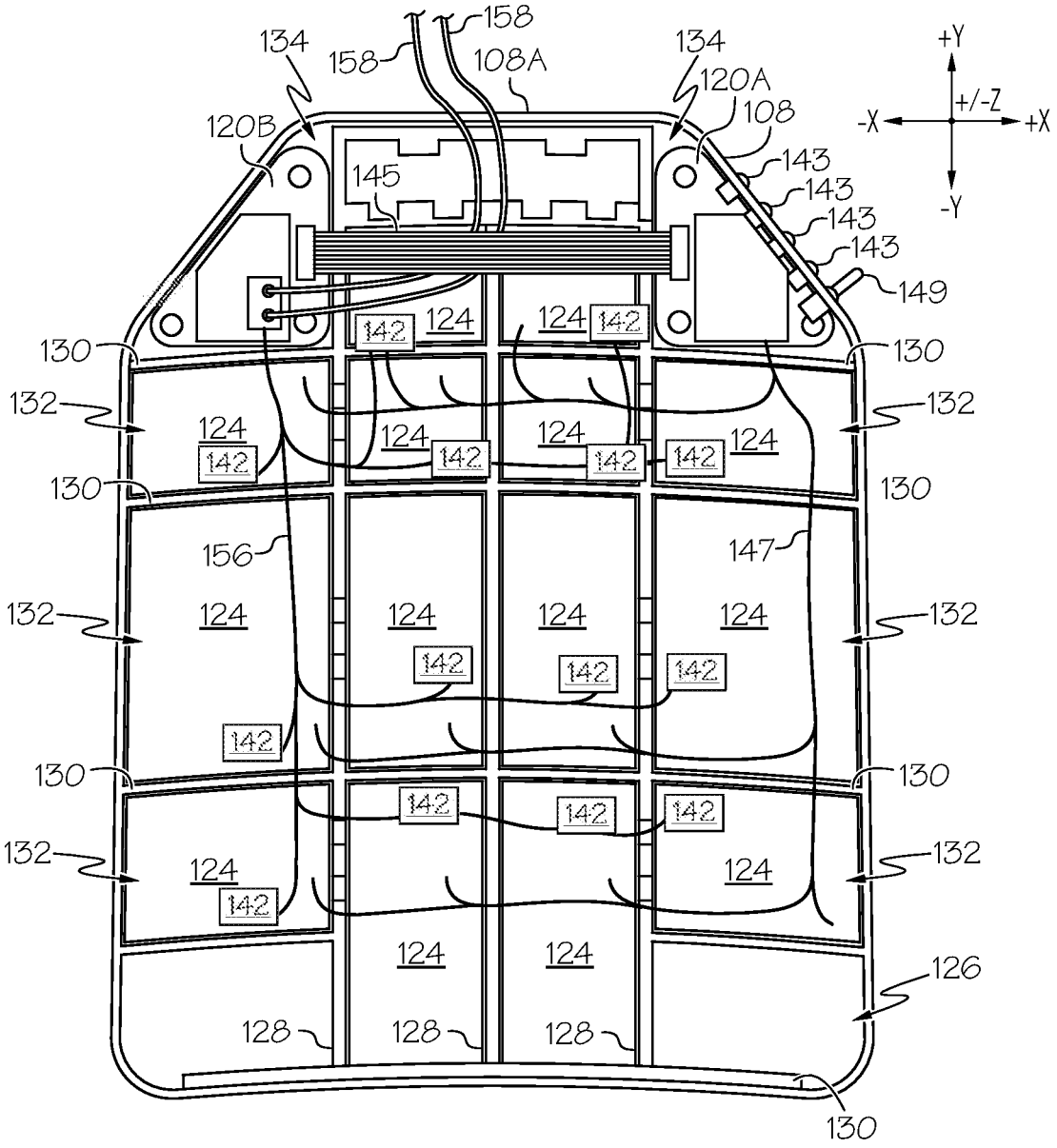
FIG. 7 schematically depicts the armor system of FIG. 1 with a top shell removed, according to one or more embodiments shown or described herein.

Referring now to FIG. 7, each battery 124 is sized to fit within each compartment 132 of the frame 118. Additionally, the control units 120A and 120B are communicatively connected via connector cable 145, which is arranged above the frame 118 and batteries 124. Additionally, control unit 102A is connected to each battery 124 via wiring harness 147, and control unit 120B is connected to each battery 124 via wiring harness 156. A plurality of fuses 142 are arranged on at least one of the battery 124 and connected to the wiring harness 156. In some embodiments, the batteries 124 may be arranged into groups of batteries 124, with a single fuse 142 controlling each group of batteries 124. This would reduce the required amount of fuses 142 required, while allowing the same amount of batteries 124 to be used. In other embodiments, each battery 124 may be connected to an individual fuse 142. The fuses 142 prevent excessive current draw (and thus heat generation) during a short-circuit scenario caused by ballistic damage to the any battery 124 and allow the rest of the batteries 124 to continue to operate and the system to continue to function and output power with a reduced capacity.

Figure 8:
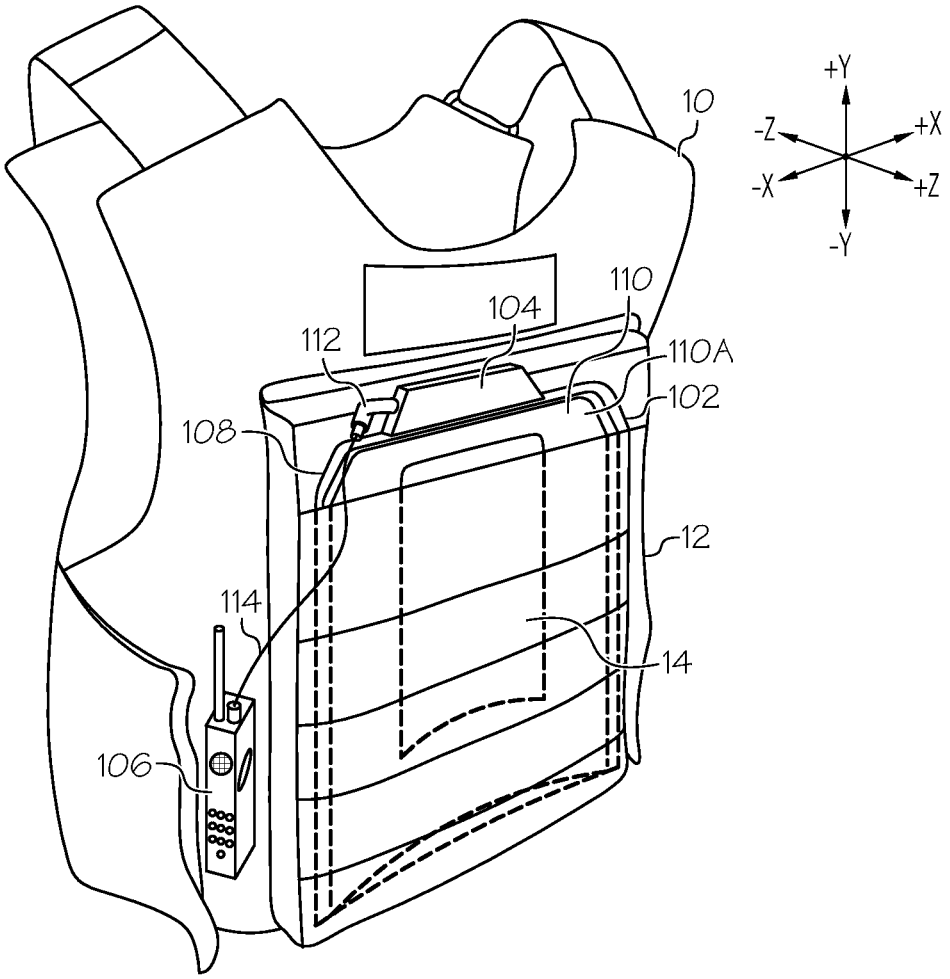
FIG. 8 schematically depicts the armor system of FIG. 1 arranged within a carrier vest, according to one or more embodiments shown or described herein.

Referring now to FIG. 8, the armor system 100 may be used in combination with a carrier vest 10. The carrier vest 10 includes a ballistic panel holding 12, which is sized to hold the armor system 100 in the correct position on a user's body. Additionally, am exterior ballistic panel 14 may be secured to an external face 110A of the housing case 102 to provide additional ballistic protection. In some embodiments and exterior ballistic panel 14 is not required. Additionally, armor system 100 may be connected to an external device 106 via external connector 104, socket 112, and flexible power cable 114. Additionally, the housing case 102 may further include hook and loop fasteners on the exterior of the housing case to secure the armor system 100 to a user or a carrier vest 10.

It should now be understood that embodiments described herein are directed to an armor system that generally includes a housing case, an interior ballistic panel, a frame, a power source, and a control unit. The housing case includes a top shell and a bottom shell, where the top shell is removably secured to the bottom shell, forming a cavity. The interior ballistic panel is removably arranged within the cavity between the top shell and the bottom shell. The frame is arranged within the cavity between the top shell and the interior ballistic panel, the frame including a compartment. The power source is arranged within the compartment of the frame, and the control unit is communicatively connected to the power source to manage operation of the power source. The interior ballistic panel, frame, and power source may be easily removed from the cavity of the housing case. For example, the interior ballistic panel could be removed if additional ballistics protection is not required beyond the level of ballistic protection of the housing case. Accordingly, the interior ballistic panel can replaced with a different ballistic protection panel, form a small arms protective panel, to a soft Kevlar® (E.I. du Pont de Nemours and Company, Midland, Mich.) insert.

The singular forms "a", "an" and "the" include plural referents, unless the context clearly dictates otherwise.

It is further noted that spatially oriented terms like "top", "bottom," and similar are not utilized herein to limit the scope of the claimed invention or to imply that certain special orientations are critical, essential, or even important to the structure or function of the claimed invention. Rather, these terms are merely intended to provide relative positions of components in a commonly understood manner.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used in this disclosure and in the appended claims, the words "comprise," "has," and "include" and all grammatical variations thereof are each intended to have an open, non-limiting meaning that does not exclude additional elements or steps.

It will be apparent to those skilled in the art that various modifications and variations can be made to the embodiments described herein without departing from the spirit and scope of the claimed subject matter. Thus, it is intended that the specification cover the modifications and variations of the various embodiments described herein provided such modification and variations come within the scope of the appended claims and their equivalents.

What is claimed is:

1. An armor system, comprising:

a ballistic housing case, comprising:

a top shell; and a bottom shell secured directly to the top shell such that the ballistic housing case is environmentally sealed against dust and water intrusion;

wherein the housing case is rigid, and wherein the top shell and the bottom shell form a cavity which is enclosed by the top shell and the bottom shell;

a frame arranged within the cavity between the top shell and the bottom shell, the frame comprising a plurality of compartments formed by a plurality of perpendicularly arranged ribs forming the frame;

a plurality of channels arranged in the ribs forming the frame, the channels formed by removal of at least a portion of the rib to form a through hole connecting adjacent compartments;

a power source arranged within at least one of the plurality of compartments; and a control unit communicatively connected to the power source with wires passing through the channels arranged in the ribs to manage operation of the power source.

2. The armor system of claim 1, wherein the system further comprises an interior ballistic panel removably arranged within the cavity between the top shell and the bottom shell.

3. The armor system of claim 1, wherein the control unit is arranged within at least one compartment of the frame.

4. The armor system of claim 1, wherein the power source is a plurality of batteries comprising at least one fuse communicatively connected between the control unit and the plurality of batteries.

5. The armor system of claim 4, wherein the plurality of batteries are arranged within corresponding compartments of the plurality of compartments of the frame.

6. The armor system of claim 4, further comprising an external connector passing through the housing case and communicatively connected to the plurality of batteries and the control unit.

7. The armor system of claim 6, wherein the external connector comprises:

a socket communicatively coupled to the plurality of batteries; and, a flexible power cable removably secured to the socket, wherein the flexible power cable allows current to be transmitted from the plurality of batteries to an external device.

8. The armor system of claim 1, wherein the housing case having ballistic resistance is formed from a fiber-reinforced composite material comprising reinforcement material and a polymer.

9. The armor system of claim 8, wherein the reinforcement material comprises one or more components selected from the group consisting of carbon fiber, glass fiber, aramid fiber, polypropylene fiber, polyethylene fiber, hybrid laminates, thermoplastic prepreg, or combinations thereof, and wherein the polymer comprises one of more components selected from the group consisting of polypropylene, polyethylene, polyether ether ketone, polyphenylene oxide, polyphenylene ether, polyvinylidenefluoride, epoxy, vinyl ester, polyester, polyurethane, thermoplastic elastomer, thermoset elastomer, or combinations thereof.

10. An armor system, comprising:

a housing case, comprising:

a top shell; and a bottom shell secured directly to the top shell such that the housing case is environmentally sealed against dust and water intrusion;

wherein the housing case is rigid, and wherein the top shell and the bottom shell form a cavity which is enclosed by the top shell and the bottom shell;

an interior ballistic panel removably arranged within the cavity between the top shell and the bottom shell;

a plurality of longitudinally arranged ribs arranged within the cavity;

a plurality of latitudinally arranged ribs arranged over the plurality of longitudinally arranged ribs, wherein the plurality of longitudinally arranged ribs are secured to the plurality of latitudinally arranged ribs, forming a plurality of compartments;

wherein the plurality of longitudinally arranged ribs and the plurality of latitudinally arranged ribs are integral with one another to form a frame;

a plurality of channels positioned in the latitudinally arranged ribs forming the frame, the channels formed by removal of at least a portion of the latitudinally arranged rib to form a through hole connecting adjacent compartments;

a power source arranged within at least one of the plurality of compartments; and a control unit arranged within at least one of the plurality of compartments and communicatively connected to the power source with wires passing through the channels arranged in the ribs to manage operation of the power source.

11. The armor system of claim 10, wherein the power source is a plurality of batteries comprising at least one fuse communicatively connected between the control unit and the plurality of batteries.

12. The armor system of claim 11, further comprising an external connector passing through the housing case and communicatively connected to the plurality of batteries and the control unit.

13. The armor system of claim 12, wherein the external connector comprises:

a socket communicatively coupled to the plurality of batteries; and, a flexible power cable removably secured to the socket, wherein the flexible power cable allows current to be transmitted from the plurality of batteries to an external device.

14. The armor system of claim 10, wherein the housing case having ballistic resistance is formed from a fiber-reinforced composite material comprising reinforcement material and a polymer.

15. The armor system of claim 14, wherein the reinforcement material comprises one or more components selected from the group consisting of carbon fiber, glass fiber, aramid fiber, polypropylene fiber, polyethylene fiber, hybrid laminates, thermoplastic prepreg, or combinations thereof, and wherein the polymer comprises one of more components selected from the group consisting of polypropylene, polyethylene, polyether ether ketone, polyphenylene oxide, polyphenylene ether, polyvinylidenefluoride, epoxy, vinyl ester, polyester, polyurethane, thermoplastic elastomer, thermoset elastomer, or combinations thereof.

16. An armor system comprising:

a carrier vest;

a ballistic panel holding pouch operatively arranged on the carrier vest;

a housing case, comprising:

a top shell; and a bottom shell secured directly to the top shell such that the housing case is environmentally sealed against dust and water intrusion;

wherein the housing case is rigid, and wherein the top shell and the bottom shell form a cavity which is enclosed by the top shell and the bottom shell;

an interior ballistic panel removably arranged within the cavity between the top shell and the bottom shell;

a frame arranged within the cavity between the top shell and the interior ballistic panel, the frame comprising a plurality of longitudinally arranged ribs and a plurality of latitudinally arranged ribs forming a plurality of compartments within the frame;

a plurality of channels positioned in the latitudinally arranged ribs forming the frame, the channels formed by removal of at least a portion of the latitudinally arranged rib to form a through hole connecting adjacent compartments;

a power source arranged within the compartment of the frame; and a control unit communicatively connected to the power source with wires passing through the channels arranged in the ribs to manage operation of the power source, wherein the housing case is arranged within the ballistic panel holding pouch.

17. The armor system of claim 16, further comprising an external connector passing through the housing case and communicatively connected to the power source and the control unit.

* * * * *